US008690989B2

(12) United States Patent
Baumgartner et al.

(10) Patent No.: US 8,690,989 B2
(45) **Date of Patent: *Apr. 8, 2014**

(54) AIR QUALITY ENHANCEMENT SYSTEM

(75) Inventors: John Baumgartner, Olivia, MN (US); Matthew Baumgartner, Olivia, MN (US)

(73) Assignee: Baumgartner Environics, Inc, Olivia, MN (US)

( * ) Notice: Subject to any disclaimer, the term of this patent is extended or adjusted under 35 U.S.C. 154(b) by 275 days.

This patent is subject to a terminal disclaimer.

(21) Appl. No.: 13/223,971

(22) Filed: Sep. 1, 2011

(65) Prior Publication Data

US 2011/0308384 A1 Dec. 22, 2011

Related U.S. Application Data

(63) Continuation-in-part of application No. 12/765,315, filed on Apr. 22, 2010, now Pat. No. 8,460,430.

(60) Provisional application No. 61/172,255, filed on Apr. 24, 2009.

(51) Int. Cl.
*B03C 3/68* (2006.01)
*B03C 3/74* (2006.01)

(52) U.S. Cl.
USPC ..... 95/6; 95/74; 95/76; 96/22; 96/39; 96/40; 96/94; 96/97; 119/437

(58) Field of Classification Search
USPC ..... 95/6, 74, 76, 77; 96/22, 39, 40, 51, 94, 96/97; 119/437
See application file for complete search history.

(56) References Cited

U.S. PATENT DOCUMENTS

| | | | | | |
|---|---|---|---|---|---|
| 2,209,798 | A | * | 7/1940 | Subkow | 208/350 |
| 3,765,154 | A | * | 10/1973 | Hardt et al. | 96/88 |
| 4,484,249 | A | | 11/1984 | Saurenman | |
| 5,125,936 | A | * | 6/1992 | Johansson | 96/84 |
| 5,323,508 | A | | 6/1994 | Sheldrake | |

(Continued)

FOREIGN PATENT DOCUMENTS

| | | | | | |
|---|---|---|---|---|---|
| JP | 5-154409 | A | * | 6/1993 | 96/97 |
| WO | 2011/006262 | A1 | | 1/2011 | |

OTHER PUBLICATIONS

Mitchell, Bailey W., and John W. Baumgartner. "Electrostatic Space Charge System for Reducing Dust in Poultry Production Houses and the Hatchery."

*Primary Examiner* — Richard L Chiesa
(74) *Attorney, Agent, or Firm* — Dicke, Billig & Czaja, PLLC

(57) ABSTRACT

A system for enhancing air quality by collecting airborne particles. The system includes at least one ground plane, at least one corona point, an ionization field strength adjustment mechanism and a cleaning mechanism. The at least one ground plane is operably mounted proximate to where the airborne particles are present. The at least one ground plane includes at least one ground plane surface. The least one corona point operably is mounted to the at least one ground plane for causing an accumulation of particles to be deposited on the at least one ground plane surface. The ionization field strength adjustment mechanism enables a distance between the at least one corona point and the at least one ground plane to be adjusted. The cleaning mechanism is capable of removing the accumulation of particles from the at least one ground plane surface.

30 Claims, 7 Drawing Sheets

(56) References Cited

U.S. PATENT DOCUMENTS

| | | | | |
|---|---|---|---|---|
| 5,518,531 | A * | 5/1996 | Joannu | 96/55 |
| 6,126,722 | A | 10/2000 | Mitchell et al. | |
| 6,287,368 | B1 * | 9/2001 | Ilmasti | 96/19 |
| 6,508,982 | B1 * | 1/2003 | Shoji | 422/22 |
| 6,620,224 | B1 | 9/2003 | Sato | |
| 6,872,238 | B1 | 3/2005 | Truce | |
| 6,958,088 | B1 * | 10/2005 | Moriyama | 96/39 |
| 8,460,430 | B2 * | 6/2013 | Baumgartner et al. | 95/6 |
| 2004/0141874 | A1 | 7/2004 | Mullinax | |
| 2006/0180027 | A1 * | 8/2006 | McDonnell et al. | 96/40 |
| 2007/0151448 | A1 * | 7/2007 | Taylor et al. | 95/57 |
| 2007/0165353 | A1 | 7/2007 | Fleischer | |
| 2007/0193444 | A1 * | 8/2007 | Hendricksen | 95/57 |
| 2007/0240572 | A1 | 10/2007 | Kiern et al. | |
| 2010/0269691 | A1 | 10/2010 | Baumgartner et al. | |
| 2011/0308384 | A1 | 12/2011 | Baumgartner et al. | |

* cited by examiner

AIR QUALITY ENHANCEMENT SYSTEM

REFERENCE TO RELATED APPLICATION

This application is a continuation-in-part of U.S. Pat. No. 8,460,430, and which claimed priority to U.S. Provisional Application No. 61/172,255, which was filed on Apr. 24, 2009, the contents of which are incorporated herein by reference.

FIELD OF THE INVENTION

The invention relates generally to a method of increasing air quality. More particularly, the invention relates to a method of increasing air quality by maintaining ionization field strength to reduce airborne particles.

BACKGROUND OF THE INVENTION

Poultry production includes two major categories—meat production and egg production. Currently, most poultry produced in North America is grown under close control on highly specialized farms. The evolution from small flocks to large commercial units after World War II was facilitated by advances in the knowledge of nutrition, breeding, housing, disease control, processing of poultry and eggs, and by improvements in transportation and refrigeration that made possible distant marketing of fresh products.

Poultry produced for meat production is commonly referred to as broilers. During the last few decades, broiler production has greatly increased as a result of Americans becoming more health conscious, as poultry is viewed by certain persons as healthier than other meats that are typically consumed by humans. The increased broiler production also resulted from the increased demand for export of poultry products to other countries.

The facilities that are typically used in conjunction with commercial poultry production each contain a relatively large number of birds. For example, each poultry production facility may house more than 20,000 birds.

The poultry production facilities confine the birds to protect them from predators and environmental extremes that would cause mortality or reduce growth, feed efficiency, immunocompetence, fertility or egg production. The poultry production facilities thereby facilitate efficiently managing a large volume of birds.

While the poultry production facilities enable a large volume of birds to be simultaneously raised, the large volume of birds generate waste materials that must be dealt with. One such waste material is airborne dust and biological particles.

Electrostatic precipitation of dust has been historically used to control emission from industrial smokestacks. This technique has also been used to remove dust from the air inside a living space.

When using electrostatic precipitation, ions placed into the air space that is to be treated to polarize any particles in the air. Thereafter, the polarized particles are removed from the air by attraction to a grounded collection plate.

Over time, a progressively thick layer of particles collect on the collection plate. This progressively thicker layer of particles reduces the efficiency of the electrostatic precipitation system because the layer of particles insulates the collection plate from the polarized airborne particles. To enhance the efficiency of the electrostatic precipitation system, it is necessary to periodically clean the collection plates to dislodge the accumulated particles.

Disadvantages of these types of electrostatic precipitation systems are that only a limited airspace may be treated by one collection plate. The cost and size of multiple collection plate systems reduces the feasibility of using electrostatic particle ionization in very dusty and larger air spaces.

Mitchell et al., U.S. Pat. No. 6,126,722, uses corona points to discharge negative ions into a large air space that is being treated. This system relies on grounded surfaces inside and confining the air space to attract and hold the ionized particles.

While this system is effective at economically treating a large, dusty air space to reduce dust in the air, the polarized particles accumulate on the grounded surfaces and cause the grounded surfaces to become progressively more insulated. This process decreases the efficiency of this system.

Even though manual and/or mechanical cleaning will maintain the desired ionization level, the cost and limited ability to manually or mechanically clean grounded surfaces makes such a system a less than optimal result.

SUMMARY OF THE INVENTION

An embodiment of the invention is directed to a method of improving air quality in a poultry house by maintaining ionization field strength in an electrostatic particle ionization system that is placed within the poultry production facility.

Another embodiment of the invention is directed a system for enhancing air quality by collecting airborne particles. The system at least one ground plane, at least one corona point, an ionization field strength adjustment mechanism and a cleaning mechanism.

The at least one ground plane is operably mounted proximate to where the airborne particles are present. The at least one ground plane includes at least one ground plane surface. The at least one corona point is operably mounted to the at least one ground plane for causing an accumulation of particles to be deposited on the at least one ground plane surface.

The ionization field strength adjustment mechanism enables a distance between the at least one corona point and the at least one ground plane to be adjusted. The cleaning mechanism is capable of removing the accumulation of particles from the at least one ground plane surface.

Another embodiment of the invention is directed to a system for enhancing air quality by collecting airborne particles. The system includes a movable support system, at least one ground plane, at least one corona point and an ionization field strength adjustment mechanism.

The at least one ground plane is operably mounted with respect to the movable support system. The at least one ground plane includes at least one ground plane surface. The at least one corona point is operably mounted with respect to the movable support system for causing an accumulation of particles to be deposited on the at least one ground plane surface. The ionization field strength adjustment mechanism enables a distance between the at least one corona point and the at least one ground plane to be adjusted.

Another embodiment of the invention is directed to a system for enhancing air quality by collecting airborne particles. The system includes an enclosure, at least one ground plane, a ground plane mounting mechanism, at least one corona point, a corona point mounting mechanism and an ionization field strength adjustment mechanism.

The ground plane mounting mechanism operably mounts the at least one ground plane within the enclosure. The corona point mounting mechanism operably mounts the at least one corona point within the enclosure. The ionization field strength adjustment mechanism enables a distance between the at least one corona point and the at least one ground plane to be adjusted.

Another embodiment of the invention is directed to a method for enhancing air quality by collecting airborne particles. At least one ground plane is operably mounted proximate to where the airborne particles are present. The at least one ground plane includes at least one ground plane surface.

At least one corona point is operably mounted with respect to the at least one ground plane. Ionization energy is emitted from the at least one corona point. Particles are collected on the at least one ground plane surface.

An ionization field strength generated between the at least one corona plate and the at least one ground plane is adjusted with an ionization field strength adjustment mechanism by changing a distance between the at least one corona point and the at least one ground plane. Particles are removed from the at least one ground plane surface with a cleaning mechanism.

Another embodiment of the invention is directed to an air quality enhancement method for collecting airborne particles. An enclosure is provided in which airborne particles are present.

At least one ground plane is operably mounted within the enclosure using a ground plane mounting mechanism. The ground plane mounting mechanism enables a height of the at least one ground plane within the enclosure to be adjusted.

At least one corona point is operably mounted within the enclosure using a corona point mounting mechanism. The corona point mounting mechanism enables a height of the at least one corona point within the enclosure to be adjusted. An ionization field strength adjustment mechanism enables a distance between the at least one corona point and the at least one ground plane to be adjusted.

BRIEF DESCRIPTION OF THE DRAWINGS

The accompanying drawings are included to provide a further understanding of embodiments and are incorporated in and constitute a part of this specification. The drawings illustrate embodiments and together with the description serve to explain principles of embodiments. Other embodiments and many of the intended advantages of embodiments will be readily appreciated as they become better understood by reference to the following detailed description. The elements of the drawings are not necessarily to scale relative to each other. Like reference numerals designate corresponding similar parts.

DETAILED DESCRIPTION OF THE PREFERRED EMBODIMENTS

An embodiment of the invention is directed to a method of maintaining ionization field strength between corona points and the ground plane in an electrostatic particle ionization system.

Increasing the electrostatic field strength will maintain the discharge of negative ions into an air space at a desired level. This technique thereby maintains the dust reduction potential of the system over a longer period of time as compared to electrostatic particle ionization systems in which the field strength is not adjusted.

Figure 1:
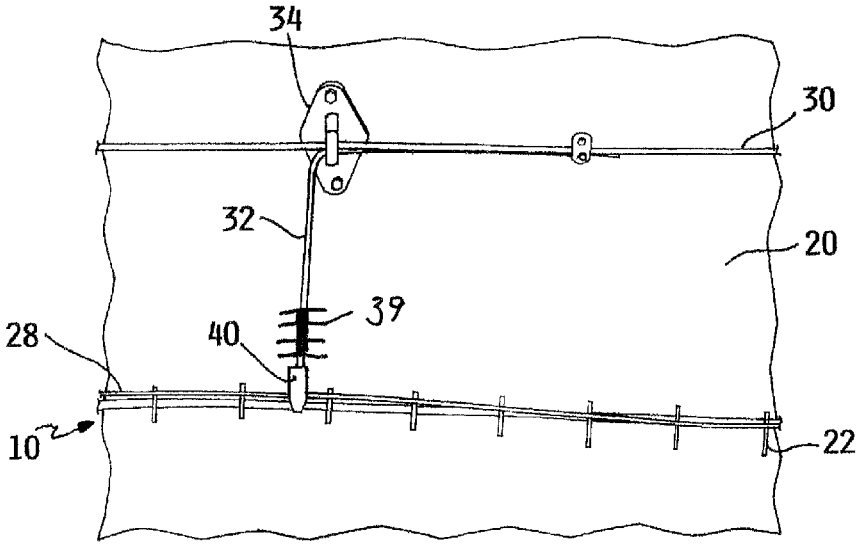
FIG. 1 is a view of a corona point in an electrostatic particle ionization system.
Figure 2:
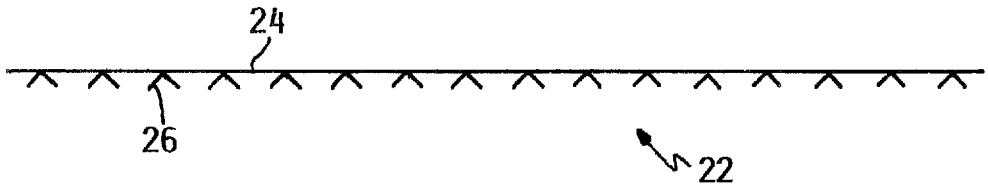
FIG. 2 is a side view of a corona point assembly for use in conjunction with the electrostatic particle ionization system.
Figure 3:
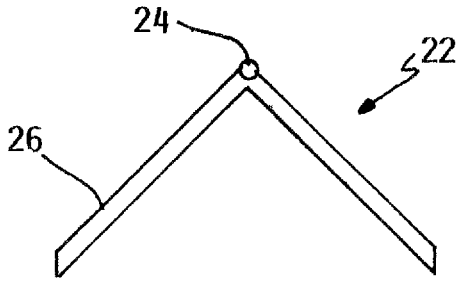
FIG. 3 is a side view of a corona point that is mounted on a spine in the corona point assembly.
Figure 4:
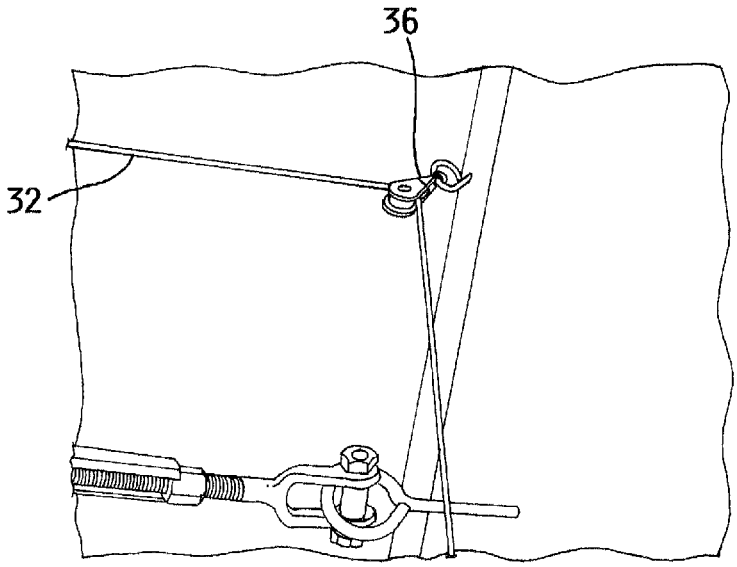
FIG. 4 is a view of a height adjustment mechanism for use in conjunction with the electrostatic particle ionization system.

The electrostatic particle ionization system 10 generally includes at least one ground plane 20 and at least one corona point 22, as illustrated in FIGS. 1-3. When the electrostatic particle ionization system is used in conjunction with a poultry production facility, such as is illustrated in FIG. 4, the ground plane 20 may be incorporated into a component of the poultry production facility. In certain embodiments, the ground plane 20 may be incorporated into and/or attached to a ceiling of the poultry production facility or other enclosure in which airborne particles are present and/or generated.

In one configuration the ground plane 20 may be fabricated from a corrugated material. An advantage of using corrugated material to fabricate the ground plane 20 is that the corrugations increase the surface are of the ground plane 20, which thereby increases the volume of particles that may be retained on the surface of the ground plane 20. It is possible for the ground plane 20 to take a variety of other configurations such as being substantially flat and/or being fabricated in a non-continuous array.

The ground plane 20 may be fabricated from a variety of materials using the concepts of the invention such that the ground plane 20 is capable of being charged to facilitate attracting particles to the ground plane 20.

The corona point assembly 22 may include a spine 24 and at least one corona point 26 that is mounted to the spine 24, as illustrated in FIG. 2. While the spine 24 is illustrated as being substantially linear, it is possible for the spine 24 to take a variety of other configurations. The spine 24 may be fabricated from a conductive material. An example of one such conductive material is a stainless steel rod. In certain embodiments, the stainless steel rod has a diameter of about 16 gauge.

A factor in selecting the size of the spine 24 is that the spine 24 have sufficient strength to resist bending and/or deformation during the use of the electrostatic particle ionization system 10. Another factor in selecting the size of the spine 24 is that the spine has the capacity to handle the current utilized during the operation of the electrostatic particle ionization system 10.

While it is possible to form the spine 24 with very large lengths such as greater than 100 feet, in certain embodiments, the spine 24 has a length of between about 2 feet and 10 feet. Using spine 24 with a length in this range enables the electrostatic particle ionization system 10 to be readily configuration for use in conjunction with enclosures having various shapes and sizes.

In certain embodiments, a plurality of the spines 24 may be attached to a conductive wire 28 in series to enable the system of the current invention to be used in applications that are relatively long such as having a length of more than 100 feet.

The corona points 26 may take a variety of configurations. In certain embodiments, the corona points 26 each have a generally V-shaped configuration with the legs being oriented at an angle with respect to each other of up to about 150 degrees, as illustrated in FIG. 3. In other embodiments, the legs of the corona point 26 may be oriented at an angle of about 90 degrees.

The corona points 26 may be fabricated from a variety of materials using the concepts of the invention. In certain embodiments, the corona points may be fabricated from a conductive material such as stainless steel rod. The stainless steel rod may have a diameter of about 16 gauge.

A variety of techniques may be used to attach the corona points 26 to the spine 24. The selected connection technique should provide a high level of electrical conductivity between the spine 24 and the corona points 26. An example of one such suitable technique that may be used to connect the corona points 26 to the spine 24 is welding.

Distal ends of the corona points 26 may be tapered to a point. It is believed that the sharpness of the point at the distal ends of the corona points 26 may play a role in the ionization performance of the system. A length of each of the legs of the corona point 26 may be substantially equal to each other.

In certain embodiments, the length of the legs of the corona point 26 may be between about 0.25 inches and about 5 inches. In other embodiments, the length of the legs of the corona points 26 is about 0.75 inches.

A plurality of corona points 26 are attached to the spine 24. In certain embodiments, the corona points 26 are mounted in a spaced-apart relationship with respect to each other as well as a spaced-apart relationship from the ends of the spine 24. The spacing between adjacent corona points 26 may be substantially equal.

In certain embodiments, the corona points 26 are mounted at a spacing of between about 1 and 6 inches. In other embodiments, the corona points 26 are mounted at a spacing of approximately 2.275 inches. A spacing between the corona points 26 and the end of the spine 24 may be about ½ of the distance between the corona points. In certain embodiments, the spacing between the corona point 26 and the end of the spine 24 is about 1.25 inches. Utilizing the preceding dimensions, there may be 16 corona points 26 attached to a spine 24 having a length of about 36 inches.

The corona point assembly 22 is movable mounted with respect to the ground plane 20 such that a distance between the corona point assembly 22 and the ground plane 20 may be varied. A height adjustment system 30 may be used to movably mount the corona point assembly 22. In certain embodiments, the height adjustment system 30 may include a cable 32. As an alternative to or addition to changing the position of the corona point assembly 22, it is possible to movably mount the ground plane 20.

While the figures illustrate that the cable 32 attached to the corona point assembly 22 at a single location, it is possible to attach the cable 32 to the corona point assembly 22 at multiple locations to provide adequate support to the corona point assembly 22 so that a distance between the ground plane 20 and the corona point assembly 22 may be accurately maintained.

The cable 32 may be insulated to ensure correct operation of the electrostatic particle ionization system 10 by preventing current from traveling directly between the cable 32 and the ground plane 20.

In the situation where the ground plane 20 is the ceiling of the poultry production facility, at least one guide 34 may be attached to the ground plane 20, as illustrated in FIG. 1. The at least one guide 34 is adapted to receive the cable 32. A guide 36 may also be placed proximate to an intersection of the ceiling and a side wall, as illustrated in FIG. 4. The guide 36 also controls the positioning of the cable 32.

Similar to the cable 32, at least one of the guide 34 and the guide 36 may be insulated to prevent current traveling directly from the cable 32 to the ground plane 20 through one of the guides 34, 36.

Figure 5:
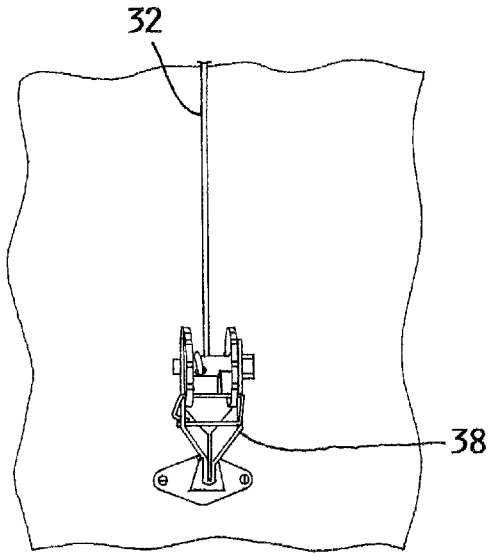
FIG. 5 is a view of an adjustment mechanism for use in conjunction with electrostatic particle ionization system.

An adjustment mechanism 38 may be attached to an end of the cable 32, as illustrated in FIG. 5. The adjustment mechanism 38 may be attached to the side wall at a height that facilitates a person activating the adjustment mechanism 38 while standing on the ground.

The adjustment mechanism 38 may take a variety of forms using the concepts of the invention. In certain embodiments, the adjustment mechanism 38 is a ratchet that is operable in a wind mode, an unwind mode and a lock mode.

A distance between the corona points 22 and the ground plane 20 may be varied to maintain a desired amperage in the electrostatic particle ionization system. In certain embodiments, the distance between the corona points 22 and the ground plane 20 may be between about 6 inches and 12 inches.

The components of the height adjustment mechanism 30 may be electrically insulated from the corona points 22. In certain embodiments, the electric insulating material may be provided by a polypropylene or TEFLON spacer 40.

To further enhance the reliability of the electrostatic particle ionization system 10, at least one fin 39 may be placed on the cable 32 proximate the connection of the cable 32 to the corona point assembly 22.

In another embodiment, the at least one fin 39 may have a connector proximate upper and lower ends thereof. The at least one fin 39 could then be used to connect the cable 32 to the corona point assembly 22.

In certain embodiments, a plurality of fins 39 may be placed on the cable 32 in a spaced apart configuration as illustrated in FIG. 1. Each of the fins 39 may be generally flat and be formed with a circular configuration.

In an alternative embodiment, the fins 39 may be oriented downward such as in a frustro conical configuration. The fins 39 may be oriented generally transverse to the orientation of the cable 32 to which the fin 39 is attached.

The fins 39 may be fabricated with a diameter that is sufficiently large to reduce the potential of electrical current passing over the outer surface thereof. The desired diameter of the fin 39 could be impacted by factors such as the number of fins 39 being used and the insulating properties of the fins 39. In certain embodiments, the fins 39 may have a diameter of between about ½ of an inch and about 3 inches.

The at least one fin 39 may be fabricated from an insulating material that resists electrical current passing therethrough. The configuration of the fin 39 may also resist electrical current passing over the surface thereof.

The fin 39 may also be fabricated with a configuration that minimizes the potential of particles accumulating on the surface thereof, as such particle accumulation could negatively impact the insulating properties of the fin 39. One such configuration is the frustro conical configuration discussed above.

Even if particles accumulate on one or more of the upper fins 39, utilizing a plurality of fins 39 enables the lower fins 39 to retain a substantial portion of the insulating capabilities. Additionally, even if gravity causes particles to accumulate on the upper surfaces of the fins 39, the particles should not accumulate on the lower surfaces of the fins 39.

While an electrical current may be used in conjunction with the concepts of the invention, the electrical current may be provided with a high voltage and a low amperage to minimize potential of health hazards associated with electrical shock. In certain embodiments, the amperage used in this system may be on the order of milliamps.

The amperage of an electrostatic particle ionization system inside a clean room air space may vary based upon a variety of factors. An example of such factors includes the length of a corona point run. These factors are typically known at the outset of the ionization period.

As airborne particles collect on the ground plane 20 and begin to progressively insulate the ground plane 20 from the corona point assembly 22, the amperage drawn will begin to decrease and such change of the amperage can be monitored using an amperage monitor such as is known to a person of skill in the art. To compensate for the decrease in amperage, the electrostatic particle ionization system 10 enables the corona point assembly 22 to be moved closer to the ground plane 20. By moving the corona point assembly 22 closer to the ground plane 20, the strength of the electrostatic field will be increased, which will cause the amperage to increase. Using this technique, the ionization potential of the system can be maintained at approximately the original amperage level.

While the system illustrated in the figures is manually adjusted, it is also possible to configure the electrostatic particle ionization system 10 for automatic adjustment. In certain embodiments, the automated system may continually adjust the distance between the corona point 22 and the ground plane 20 to maintain the desired amperage.

A large percentage of airborne particles typically have a positive charge. These positively charged particles are attracted to negatively charged particles. When this process occurs, the particles become polarized. These polarized particles are attracted to each other and to grounded surfaces.

This process thereby removes the airborne particles from the air and prevents inhalation into the respiratory tract where infection can occur. When infection happens, diseases may be spread, health problems may be triggered and the immune systems of the persons, animals or birds who inhale these materials may be weakened.

The air quality is enhanced because the electrostatic particle ionization system reduces levels of particles, dust, ammonia and hydrogen sulfide in the air. The negative ions may interfere with the cellular functions of microbes. This disruption may kill a microbe and thereby eliminates the potential of the microbe infecting the birds or the persons working in the poultry production facility.

Figure 6:
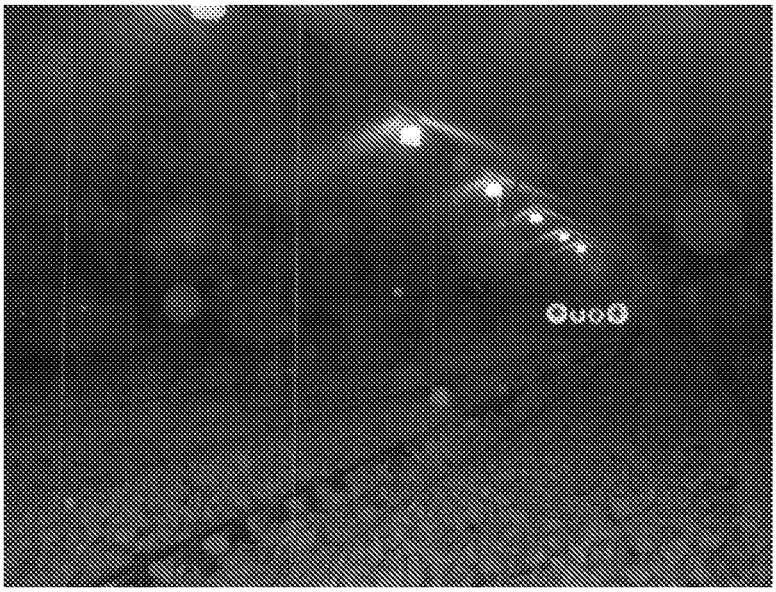
FIG. 6 is a photograph of an interior region of a poultry production facility that contains the electrostatic particle ionization system.
Figure 7:
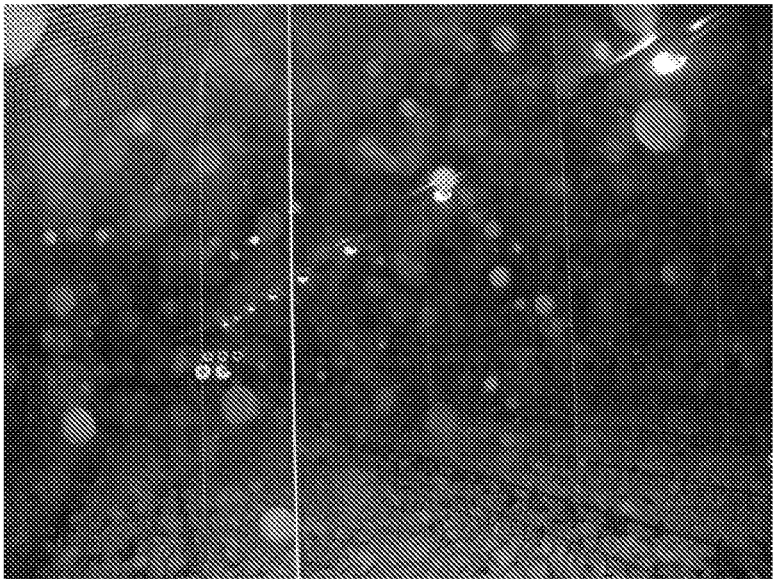
FIG. 7 is a photograph of an interior portion of a poultry production facility that does not contain the electrostatic particle ionization system.

The benefits of the use of the concepts of the current invention are illustrated in FIGS. 6-9. FIG. 6 is a photograph of an interior portion of a poultry production facility that contains the system for enhancing air quality. FIG. 7 is a photograph of an interior portion of a poultry production facility that does not contain the system for enhancing air quality.

As evidenced by these figures, the poultry production facility that does not contain the system for enhancing air quality has a considerably higher level of airborne particles when compared to the poultry production facility that contains the system for enhancing air quality.

Figure 8:
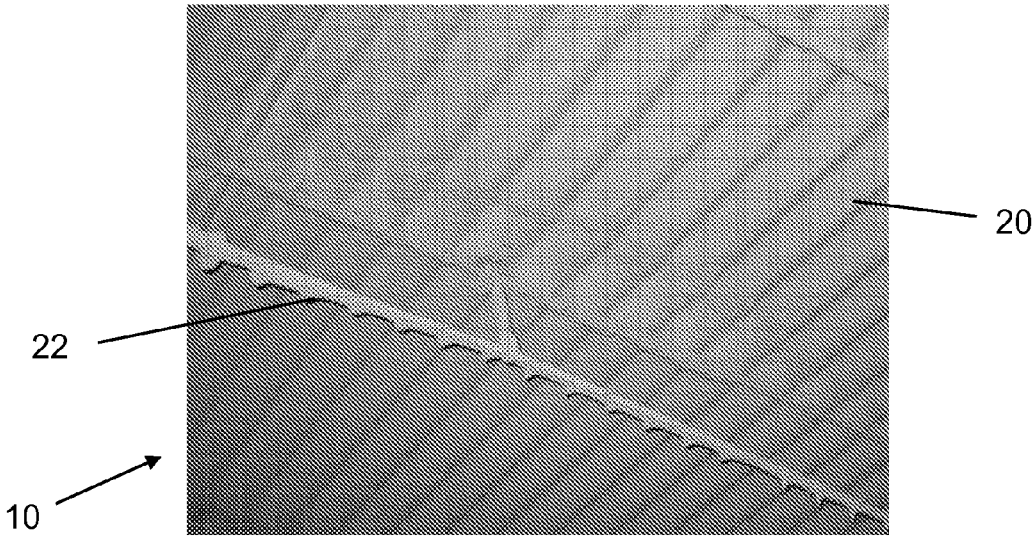
FIG. 8 is a photograph of a lower surface of the ceiling of the poultry production facility of FIG. 6.
Figure 9:
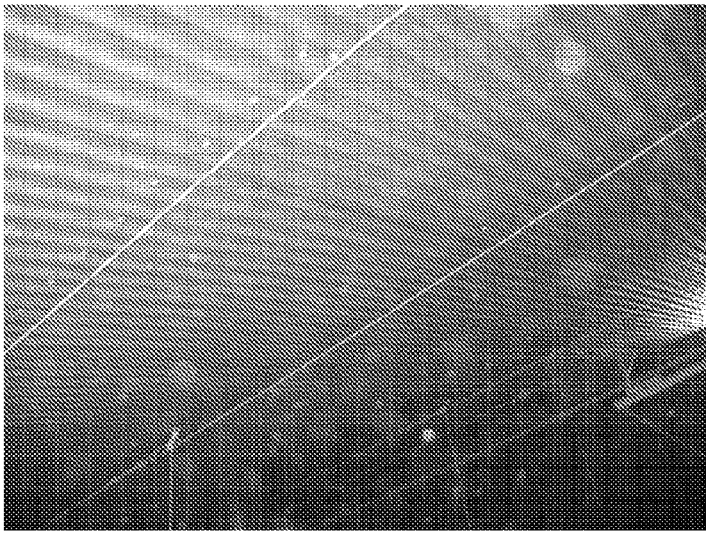
FIG. 9 is a photograph of a lower surface of the ceiling of the poultry production facility of FIG. 7.

Additionally, FIGS. 8 and 9 that are photographs of the lower surface of a ceiling in the poultry production facility that do contain and do not contain the system for enhancing air quality, respectively. The ceiling of the poultry production facility that contains the system for enhancing air quality has a significant dust layer (FIG. 8) while the ceiling in the poultry production facility that does not have the system for enhancing air quality has a much lower level of dust (FIG. 9).

While the high dust and biological particle concentrations inside of a poultry production facility will particularly benefit from the use of the system for enhancing air quality and the associated methods of the current invention, it is possible for other buildings that contain dust and biological particles to benefit from the use of the system for enhancing air quality and the associated methods of the current invention.

Yet another benefit of the invention is a reduction in the ventilation costs. In many conventional ventilation systems, a fan draws air into the poultry production facility and an exhaust port is provided where the particulate laden air is exhausted outside of the poultry production facility. Such a process could lead to environmental contamination from the dust and biological particles in the particulate laden air. Additionally, in areas where the ambient temperature is too low or too high for optimal growth of the birds, such replacement air must be heated or cooled at a significant cost.

In addition to enhancing the air quality for persons working within the poultry production facility, it has been recognized that the enhanced air quality within the poultry production facility may also increase the productivity of poultry production when compared with poultry houses that do not offer the birds the enhanced air quality.

A few factors by which the increase in the poultry production productivity may be measured are the efficiency of feed conversion and the total body mass of the poultry produced within a particular period of time. Even a relatively low increase of in the range of 3-4 percent can provide the financial justification to warrant installation of the system for enhancing air quality discussed herein.

It is possible to adapt the concepts of the invention for use in applications other than poultry for use in conjunction with other livestock such as swine, which generate a significant level of airborne particles. It is possible to adapt the concepts of the invention for use inside other structures that have high levels of airborne particles, an example of one such structure is in a welding shop.

Additionally, it is possible to employ the concepts of the invention in areas that are not confined within an enclosure. Examples of such other applications include outdoor activities that generate dust and/or biological particles.

Figure 10:
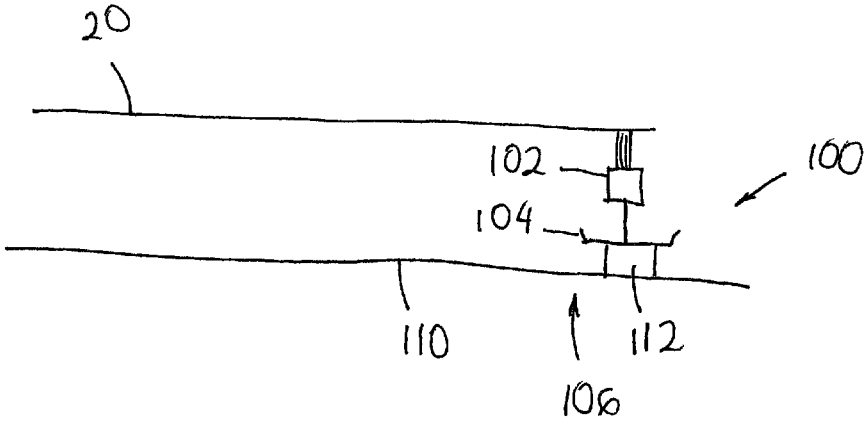
FIG. 10 is an illustration of another embodiment of the electrostatic particle ionization system.

In another aspect of the invention, the electrostatic particle ionization system 10 also includes a cleaning mechanism 100 that is used in conjunction with the ground plane 20, as illustrated in FIG. 10. The cleaning mechanism 100 periodically removes particles that have collected on the ground plane 20.

In certain embodiments, the cleaning mechanism 100 includes a sweeping portion 102 and a collection portion 104. The sweeping portion 102 may have a plurality of bristles that are similar to a conventional broom. A person of skill in the art will appreciate that other techniques may also be used to remove the particles from the ground plane 20.

While it is possible to manually move the sweeping portion 102 with respect to the ground plane 20, in certain embodiments, the sweeping portion 102 may be mounted on a mounting mechanism 106 that causes the sweeping portion 102 to move with respect to the ground plane 20.

The mounting mechanism 106 may include a track 110 that is positioned adjacent to the ground plane 20 over which the sweeping portion 102 is movable. The track 110 may be configured so that the sweeping portion 102 may contact substantially all of the ground plane 20 as the sweeping portion 102 moves over the track 110.

The mounting mechanism 106 may also include a motor 112 that is operably attached to the sweeping portion 102. The motor 112 thereby causes the sweeping portion 102 to move with respect to the track 110.

The collection portion 104 may be positioned beneath at least a portion of the ground plane 20 so that as the particles are removed from the ground plane 20 with the sweeping portion 102, the particles may be collected in the collection portion 104.

In certain embodiments, the collection portion 104 is an elongated pan. The elongated pan may include at least one upstanding edge to minimize the potential of the particles falling off of the elongated pan when dropping on to the elongated pan.

In another embodiment, the collection portion 104 may have an angled surface along at least a portion thereof. The angled surface causes particles that drop onto the collection portion 104 to move towards a lower part of the angled surface.

A collection container (not shown) may be provided proximate to the lower part of the angled surface. A drain port may be provided on the lower part of the angled surface that directs the particles into the collection container.

As an alternative to positioning the collection portion 104 beneath a substantial portion of the ground plane 20, it is possible to mount the collection portion 104 to the sweeping portion 102 so that as the sweeping portion 102 moves with respect to the ground plane 20, the collection portion 104 also moves with respect to the ground plane 20.

In such a configuration, the collection portion 104 may be formed with dimensions so that at least one of the length and the width of the collection portion 104 are larger than the length and the width of the sweeping mechanism 102.

To further enhance the ability to collect a significant portion of the particles removed from the ground plane 20, it is possible to apply an electrical charge to at least one of the ground plane 20 and the collection portion 104 that causes the particles to be attracted to the collection portion 104 after the particles have been separated from the ground plane 20 with the sweeping portion 102.

Prior to the use of the cleaning mechanism 100, the electrostatic particle ionization system 10 may be turned off so that the particles are not attracted to the ground plane 20 while the cleaning mechanism 100 is being used.

Figure 11:
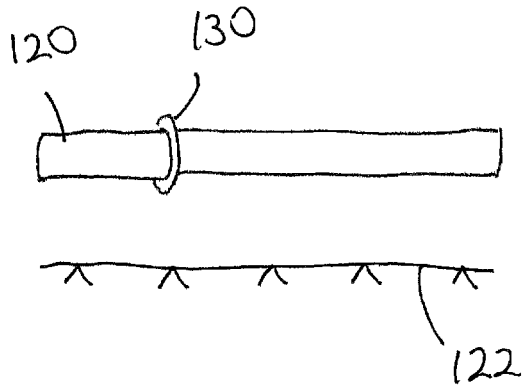
FIG. 11 is an illustration of another embodiment of the electrostatic particle ionization system.

In another embodiment, the ground plane 120 is formed with a cylindrical configuration, as illustrated in FIG. 11. Similar to the embodiment illustrated in FIGS. 1-9, the cylindrical ground plane 120 is mounted with respect to the corona point assembly 122.

Forming the ground plane 120 with a cylindrical configuration may enhance the ability to remove particles from the ground plane 120 using the cleaning mechanism 130. In this configuration, the cleaning mechanism 130 may be fabricated in a cylindrical configuration having a diameter that is slightly larger than a diameter of the ground plane 120. The cleaning mechanism 130 may have bristles that are inwardly directed so that the ends of the bristles engage the ground plane 120 as the cleaning mechanism 130 moves along the surface of the ground plane 120.

Similar to the embodiment illustrated in FIG. 10, a collection portion 134 may be used in conjunction with the cleaning mechanism 130 to collect particles that are dislodged from the ground plane 120 with the cleaning mechanism 130. The collection portion 134 may be mounted below the ground plane 120 or the collection portion 134 may be mounted to the cleaning mechanism 130.

Figure 12:
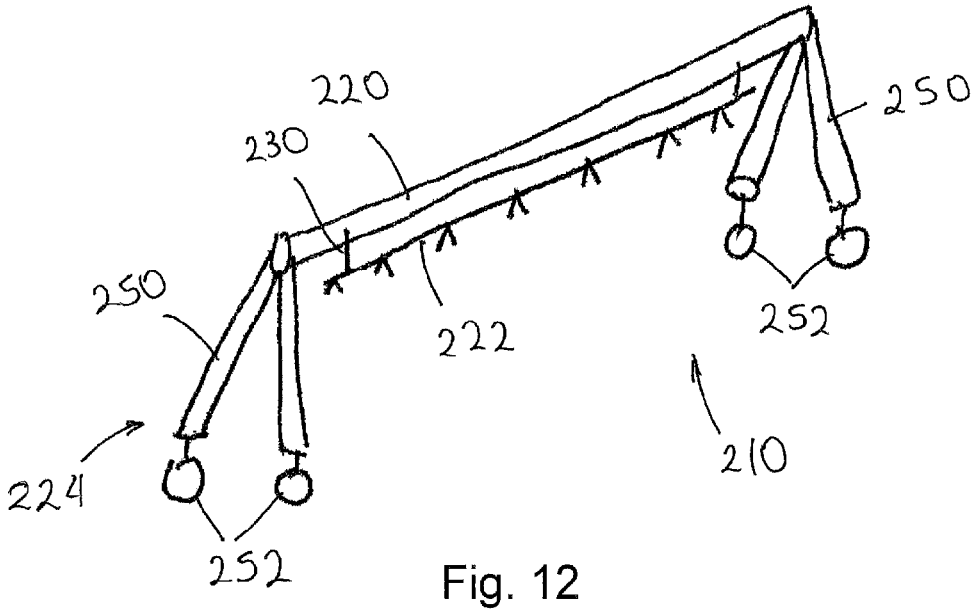
FIG. 12 is an illustration of another embodiment of the electrostatic particle ionization system.

In another configuration of the electrostatic particle ionization system at 210 least one of the ground plane 220 and the corona points 222 may be mounted on a movable support system 224, as illustrated in FIG. 12.

The movable support system 224 may include at least one side support 250. In certain embodiments, the movable support system 224 includes two side supports 250 that are mounted proximate opposite ends of the movable support system 224.

Each of the side supports 250 may be fabricated generally in the shape of the letter A so that the side supports 250 are wider proximate a lower end thereof than proximate an upper end thereof.

In certain embodiments, at least one wheel 252 is mounted to the lower end of each of the side supports 250. The at least one wheel 252 facilitates moving the electrostatic particle ionization system 210 between the locations where it is desired to use the electrostatic particle ionization system 210.

The side supports 250 may be interconnected with at least one ground plane 220. Supplemental supports may also be used between the side supports 250 to increase the rigidity of the electrostatic particle ionization system 210.

In one configuration, the ground plane 220 has a generally cylindrical configuration. It is also possible to fabricate the ground plane 220 with alternative configurations. Examples of such alternative configurations include planar and square.

The corona points 222 are mounted with respect to the other portions of the electrostatic particle ionization system 210 so that the corona points 222 may be moved with respect to the movable support system 224 similar to the manner in which the corona points 22 are movably mounted to the ground plane 20 in the embodiment of the electrostatic particle ionization system 10 that is illustrated in FIGS. 1-9.

This configuration includes a height adjustment mechanism 230 that allows a distance between the corona points 222 and the ground plane 220 to be adjusted based upon the amount of particles collected on the ground plane 220.

Similar to the embodiment illustrated in FIG. 10, a cleaning mechanism (not shown) may be used in conjunction with the electrostatic particle ionization system 210. The cleaning mechanism may include a collection portion (not shown) that is mounted with respect to the ground plane 220. In one such configuration, the collection portion is mounted to the side supports 250 beneath the ground plane 220.

The cleaning mechanism 230 also includes a sweeping portion (not shown) that is used for dislodging particles from the ground plane 220. When the ground plane 220 has a cylindrical configuration, the sweeping portion may have a cylindrical configuration with a larger diameter so that the bristles on the sweeping portion engage an outer surface of the ground plane to dislodge particles from the ground plane 220 as the sweeping portion is moved with respect to the ground plane.

Figure 13:
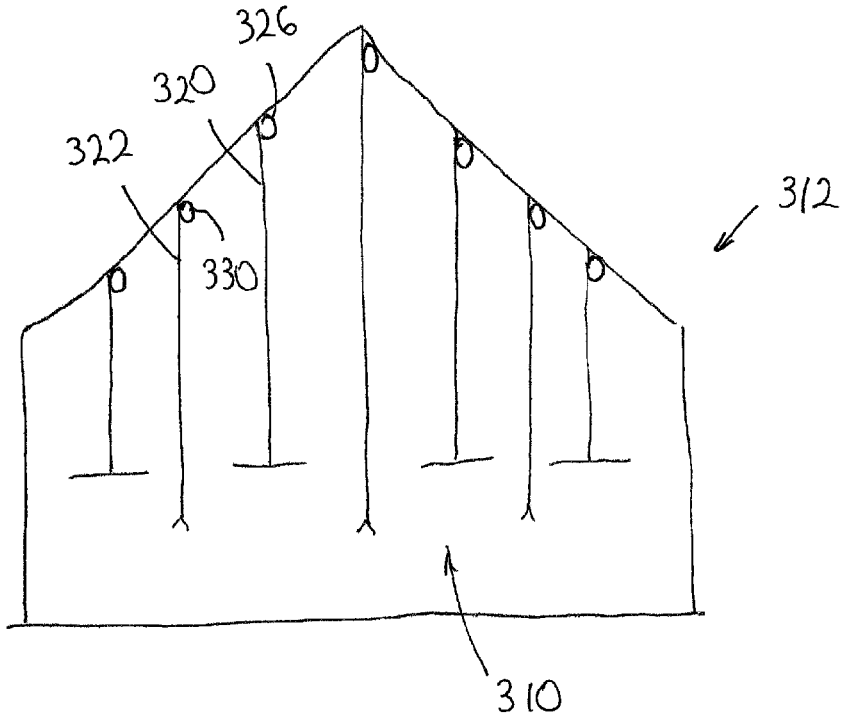
FIG. 13 is an illustration of another embodiment of the electrostatic particle ionization system.

In another configuration of the electrostatic particle ionization system 310, the ground plane 320 and the corona points 322 are movably mounted within an enclosure 312, as illustrated in FIG. 13. Movably mounting the ground plane 320 and the corona points 322 within the enclosure 312 enables these components to be positioned proximate to where the particles are generated.

Another potential benefit of movably mounting the ground plane 320 and the corona points 322 within the enclosure is that the electrostatic particle ionization system 310 may be positioned close to the ground surface such as when the particles are being generated by relatively small animals like chicks.

The system also permits the ground plane 320 and the corona points 322 to be raised so that people and or equipment may be moved into the enclosure 312 such as for cleaning the floor surface. Operating the electrostatic particle ionization system 310 in this manner minimizes the potential of damage to the ground plane 320 and the corona points 322 during such cleaning operations.

This configuration may be particularly beneficial where the enclosure 312 is a rather large building or that the roof of the enclosure 312 is located relatively far away from where the particles are generated.

In certain embodiments, the ground plane 320 may be generally planar or may be generally cylindrical. The ground plane 320 is mounted to the enclosure 312 using a height adjustment system 326.

The height adjustment system 326 may include at least one cable that is attached to the ground plane and an adjustment mechanism that is attached to the at least one cable. The adjustment mechanism adjusts the length of the cable to thereby change the height of the ground plane 320.

In one configuration, the corona points 322 are mounted with respect to the ground plane 320 so that as the position of the ground plane 320 within the enclosure 312 is changed, the corona points 322 remain at a relatively constant distance from the ground plane 320.

Similar to the embodiment illustrated in FIGS. 1-9, the corona points 322 are mounted on a height adjustment mechanism 330. The height adjustment mechanism 330 may include at least one cable and an adjustment mechanism.

In one such configuration, the height adjustment mechanism 330 extends between the corona points 322 and the ground plane 320. The adjustment mechanism varies the length of the cable to thereby change the distance between the corona points 322 and the ground plane 320.

It is also possible to mount the corona points 322 with respect to the enclosure 312 and then have the ground plane height adjustment system 326 communicate with the corona points height adjustment system 326 so that the ground plane 320 and the corona points 322 move at a relatively consistent rates.

This configuration is also useful with buildings that have a suspended ceiling. The suspended ceiling may be used where it is necessary to maintain the animals in the enclosure 312 at a temperature that is above or below ambient temperature and it is desired to minimize the volume within the enclosure 312 that is heated or cooled.

In the preceding detailed description, reference is made to the accompanying drawings, which form a part hereof, and in which is shown by way of illustration specific embodiments in which the invention may be practiced. In this regard, directional terminology, such as "top," "bottom," "front," "back," "leading," "trailing," etc., is used with reference to the orientation of the Figure(s) being described. Because components of embodiments can be positioned in a number of different orientations, the directional terminology is used for purposes of illustration and is in no way limiting. It is to be understood that other embodiments may be utilized and structural or logical changes may be made without departing from the scope of the present invention. The preceding detailed description, therefore, is not to be taken in a limiting sense, and the scope of the present invention is defined by the appended claims.

It is contemplated that features disclosed in this application, as well as those described in the above applications incorporated by reference, can be mixed and matched to suit particular circumstances. Various other modifications and changes will be apparent to those of ordinary skill.

The invention claimed is:

1. A system for enhancing air quality by collecting airborne particles, wherein the system comprises:

at least one ground plane operably mounted proximate to where the airborne particles are present, wherein the at least one ground plane comprises at least one ground plane surface;

at least one corona point operably mounted to the at least one ground plane for causing an accumulation of particles to be deposited on the at least one ground plane surface;

an ionization field strength adjustment mechanism that enables a distance between the at least one corona point and the at least one ground plane to be adjusted; and a cleaning mechanism that is capable of removing the accumulation of particles from the at least one ground plane surface.

2. The air quality enhancement system of claim 1, wherein the cleaning mechanism comprises:

a sweeping portion that removes the accumulation of particles from the at least one ground plane surface; and a collection portion that is capable of collecting the accumulation of particles that is removed from the at least one ground plane surface.

3. The air quality enhancement system of claim 2, and further comprising a mounting mechanism that causes the sweeping portion to move with respect to the at least one ground plane surface.

4. The air quality enhancement system of claim 3, wherein the mounting mechanism comprises a track and a motor, wherein the sweeping mechanism is operably attached to the track and wherein the motor causes the sweeping mechanism to move with respect to the track.

5. The air quality enhancement system of claim 2, wherein the collection portion is mounted to the sweeping portion so that the collection portion moves as the sweeping portion is moved.

6. The air quality enhancement system of claim 1, wherein the at least one ground plane has a cylindrical configuration and wherein the cleaning mechanism has a cylindrical configuration.

7. The air quality enhancement system of claim 1, wherein the ionization field strength adjustment mechanism enables a relatively constant ionization field strength to be provided between the at least one corona point and the at least one ground plane for collection of airborne particles on the at least one ground plane.

8. The air quality enhancement system of claim 7, wherein the ionization field strength adjustment mechanism monitors an amperage drawn by the air quality enhancement system and changes the distance between the at least one corona point and the at least one ground plane in response to a change in the amperage.

9. The air quality enhancement system of claim 1, wherein the at least one corona point is provided in a corona point assembly that further comprises a spine to which the at least one corona point is mounted.

10. The air quality enhancement system of claim 9, wherein the at least one corona point comprises a plurality of corona points and wherein the plurality of corona points are mounted in a spaced-apart configuration on the spine.

11. A system for enhancing air quality by collecting airborne particles, wherein the system comprises:

a movable support system comprising at least one side support and at least one wheel is mounted proximate to a lower end of the at least one side support;

at least one ground plane operably mounted with respect to the movable support system, wherein the at least one ground plane comprises at least one ground plane surface;

at least one corona point operably mounted with respect to the movable support system for causing an accumulation of particles to be deposited on the at least one ground plane surface; and an ionization field strength adjustment mechanism that enables a distance between the at least one corona point and the at least one ground plane to be adjusted.

12. The air quality enhancement system of claim 11, wherein the at least one side support comprises two side supports and wherein the two side supports are interconnected with the at least one ground plane.

13. The air quality enhancement system of claim 11, and further comprising a cleaning mechanism mounted with respect to the at least one ground plane that is capable of engaging a surface of the at least one ground plane to remove accumulation of particles from the ground plane surface.

14. The air quality enhancement system of claim 11, wherein the ionization field strength adjustment mechanism enables a relatively constant ionization field strength to be provided between the at least one corona point and the at least one ground plane for removal of airborne particles, wherein the ionization field strength adjustment mechanism monitors an amperage drawn by the air quality enhancement system and changes the distance between the at least one corona point and the at least one ground plane in response to a change in the amperage and wherein amperage draw decreases in response to insulation of the at least one ground plane caused by collection of the particles on the at least one ground plane surface.

15. The air quality enhancement system of claim 11, wherein the at least one corona point is provided in a corona point assembly that further comprises a spine to which the at least one corona point is mounted and wherein the at least one corona point comprises a plurality of corona points and wherein the plurality of corona points are mounted in a spaced-apart configuration on the spine.

16. The air quality enhancement system of claim 11, and further comprising at least one insulating fin used in conjunction with operably mounting the at least one corona point.

17. A system for enhancing air quality by collecting airborne particles, wherein the system comprises:

an enclosure in which airborne particles are present; and an electrostatic particle ionization system comprising:

at least one ground plane;

a ground plane mounting mechanism that operably mounts the at least one ground plane within the enclosure;

at least one corona point;

a corona point mounting mechanism that operably mounts the at least one corona point within the enclosure;

an amperage monitor that monitors amperage drawn by the electrostatic particle ionization system; and an ionization field strength adjustment mechanism that enables a distance between the at least one corona point and the at least one ground plane to be adjusted based upon the amperage monitored by the amperage monitor.

18. The air quality enhancement system of claim 17, wherein the ground plane mounting mechanism movably mounts the at least one ground plane within the enclosure and wherein the corona point mounting mechanism movably mounts the at least one corona point within the enclosure.

19. The air quality enhancement system of claim 18, wherein the ionization field strength adjustment mechanism enables a relatively constant ionization field strength to be provided between the at least one corona point and the at least one ground plane for removal of airborne particles from within the enclosure and wherein the ionization field strength adjustment mechanism monitors an amperage drawn by the air quality enhancement system and changes the distance between the at least one corona point and the at least one ground plane in response to a change in the amperage and wherein amperage draw decreases in response to insulation of the at least one ground plane caused by collection of the airborne particles on the at least one ground plane.

20. The air quality enhancement system of claim 18, wherein the at least one corona point is provided in a corona point assembly that further comprises a spine to which the at least one corona point is mounted and wherein the at least one corona point comprises a plurality of corona points and wherein the plurality of corona points are mounted in a spaced-apart configuration on the spine.

21. The air quality enhancement system of claim 17, and further comprising at least one insulating fin used in conjunction with the corona point mounting mechanism.

22. A method for enhancing air quality by collecting airborne particles, wherein the method comprises:

operably mounting at least one ground plane proximate to where the airborne particles are present, wherein the at least one ground plane comprises at least one ground plane surface;

operably mounting at least one corona point with respect to the at least one ground plane;

emitting ionization energy from the at least one corona point;

collecting particles on the at least one ground plane surface;

adjusting an ionization field strength generated between the at least one corona plate and the at least one ground plane with an ionization field strength adjustment mechanism by changing a distance between the at least one corona point and the at least one ground plane; and removing particles from the at least one ground plane surface with a cleaning mechanism.

23. The air quality enhancement method of claim 22, and further comprising collecting particles removed from the ground plane surface with a collection portion.

24. The air quality enhancement method of claim 23, and further comprising moving the cleaning mechanism with respect to the at least one ground plane surface with a mounting mechanism, wherein the mounting mechanism comprises a track and a motor, wherein the cleaning mechanism is operably attached to the track and wherein the motor causes the cleaning mechanism to move with respect to the track.

25. The air quality enhancement method of claim 23, and further comprising mounting the collection portion to the cleaning mechanism so that the collection portion moves as the cleaning mechanism is moved.

26. The air quality enhancement method of claim 22, wherein the ionization field strength adjustment mechanism enables a relatively constant ionization field strength to be provided between the at least one corona point and the at least one ground plane for removal of airborne particles from within the enclosure, wherein the ionization field strength adjustment mechanism monitors an amperage drawn by the air quality enhancement system and changes the distance between the at least one corona point and the at least one ground plane in response to a change in the amperage and wherein amperage draw decreases in response to insulation of the at least one ground plane caused by collection of the airborne particles on the at least one ground plane.

27. The air quality enhancement method of claim 22, and further comprising insulating the at least one corona point with at least one fin.

28. An air quality enhancement method for collecting airborne particles, wherein the method comprises:

providing an enclosure in which airborne particles are present;

operably mounting at least one ground plane within the enclosure using a ground plane mounting mechanism, wherein the ground plane mounting mechanism enables a height of the at least one ground plane within the enclosure to be adjusted;

operably mounting at least one corona point within the enclosure using a corona point mounting mechanism, wherein the corona point mounting mechanism enables a height of the at least one corona point within the enclosure to be adjusted; and adjusting a distance between the at least one corona point and the at least one ground plane using an ionization field strength adjustment mechanism to maintain a relatively constant ionization field strength between the at least one corona point and the at least one ground plane as airborne particles are removed from within the enclosure and accumulated on the at least one ground plane.

29. The air quality enhancement method of claim 28, wherein the ionization field strength adjustment mechanism monitors an amperage drawn by the air quality enhancement system and changes the distance between the at least one corona point and the at least one ground plane in response to a change in the amperage and wherein amperage draw decreases in response to insulation of the at least one ground plane caused by collection of the airborne particles on the at least one ground plane.

30. The air quality enhancement method of claim 28, and further comprising insulating the at least one corona point with at least one fin mounted with respect to the corona point mounting mechanism.

* * * * *